US007975737B2

(12) United States Patent
Griffin et al.

(10) Patent No.: US 7,975,737 B2
(45) Date of Patent: Jul. 12, 2011

(54) ROUTER BASE SECURING MECHANISM

(75) Inventors: Greg K. Griffin, Humboldt, TN (US); Randy G. Cooper, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 12/658,854

(22) Filed: Feb. 16, 2010

(65) Prior Publication Data

US 2010/0146763 A1 Jun. 17, 2010

Related U.S. Application Data

(60) Division of application No. 11/958,153, filed on Dec. 17, 2007, now Pat. No. 7,686,046, which is a continuation of application No. 10/384,510, filed on Mar. 7, 2003, now Pat. No. 7,334,613.

(60) Provisional application No. 60/418,510, filed on Oct. 15, 2002.

(51) Int. Cl.
*B27M 1/00* (2006.01)
*B27C 5/00* (2006.01)

(52) U.S. Cl. ..... 144/371; 144/136.95; 409/206; 409/209; 409/218; 409/182

(58) Field of Classification Search ..... 144/136.95, 144/154.5, 371; 409/206, 209, 210, 218, 409/182
See application file for complete search history.

(56) References Cited

U.S. PATENT DOCUMENTS

| | | | | |
|---|---|---|---|---|
| 5,139,061 | A * | 8/1992 | Neilson | 144/135.2 |
| 5,725,036 | A * | 3/1998 | Walter | 144/135.2 |
| 6,318,936 | B1 * | 11/2001 | McFarlin et al. | 409/131 |
| 6,550,154 | B1 * | 4/2003 | Smith | 33/638 |
| 6,725,892 | B2 * | 4/2004 | McDonald et al. | 144/136.95 |
| 6,863,480 | B1 * | 3/2005 | Taylor | 409/182 |
| 7,281,887 | B2 * | 10/2007 | Taylor | 409/182 |
| 7,334,613 | B2 * | 2/2008 | Griffin et al. | 144/136.95 |
| 7,686,046 | B2 * | 3/2010 | Griffin et al. | 144/136.95 |

* cited by examiner

*Primary Examiner* — Shelley Self
(74) *Attorney, Agent, or Firm* — Rhonda L. Barton; Scott B. Markow

(57) ABSTRACT

The present invention is directed to a mechanism and method for providing above the table securing/unsecuring of a router motor housing. The mechanism of the present invention employs a mechanical connection included on a pivot member to couple with a wrench device extended through the tabletop. The mechanism permits a user to adjust or release the motor housing without having to reach under the table surface.

5 Claims, 8 Drawing Sheets

ROUTER BASE SECURING MECHANISM

CROSS REFERENCE

The present application is a divisional of U.S. patent application, Ser. No. 11/958,153, filed Dec. 17, 2007, now U.S. Pat. No. 7,686,046, which is a continuation of U.S. patent application Ser. No. 10/384,510, filed Mar. 7, 2003, entitled "Router Base Securing Mechanism", now U.S. Pat. No. 7,334,613, issued Feb. 26, 2008, which claims priority to U.S. Provisional Patent Ser. No. 60/418,510 entitled "Router", filed Oct. 15, 2002, each of which is hereby incorporated by reference in its entirety.

FIELD OF THE INVENTION

The present invention relates to the field of hand tools and particularly to an apparatus and method for permitting router base securing/unsecuring from a base end.

BACKGROUND OF THE INVENTION

Routers typically include a base for supporting the router on a workpiece. Router bases usually are formed to support a router on a work surface and to permit adjustable positioning of a motor housing. Thus, allowing positioning relative to a workpiece. Previous router securing devices require the user to manipulate thumb screws, buckles and the like. Once a user positions the motor housing to the desired depth, the securing device is used to close an adjacent seam, thus drawing the base tight around the motor housing.

One difficulty experienced with current devices, is when the router is utilized with a router table. When used with a router table, the base is connected to the underside of the support surface, which extends beyond the base to support a workpiece. As a result of this arrangement, a user is forced to reach under the support surface to release the device to adjust the cut depth.

Therefore, it would be desirable to provide an apparatus and method for permitting router base securing from the base end.

SUMMARY OF THE INVENTION

Accordingly, the present invention is directed to an apparatus and method for providing router base securing/unsecuring from the base end, such as when a router is utilized with a router table. The mechanism and method of the present invention permits easy, securing/unsecuring of a router base to allow depth adjustment and motor housing removal.

In a first aspect of the invention, a base includes a receiving portion, a pivot member, and a draw member. The receiving portion includes an interior recess for accepting a motor housing. The pivot member is pivotally mounted to the receiving portion. A draw member is connected to the pivot member and to the receiving portion across a seam included in the receiving portion. The pivot member includes a mechanical connection directed towards the base end.

In another aspect of the invention, a base securing mechanism includes a receiving portion, a pivot member, a draw member, and a lever. The lever is connected to the pivot member such that a user is capable of rotating the pivot member when a base including the mechanism is disposed on a work surface. The pivot member includes a mechanical connection directed towards the base end. In further embodiments, at least one of the lever and the pivot member includes a cam segment or curved surface with varying radius for tensioning against the draw member to cause the receiving portion to secure/un-secure a received motor housing.

In a further aspect of the invention, a router table includes a support surface, a receiving portion, a pivot member and a draw member. The support surface includes a first side for supporting a workpiece and a second side. The receiving portion is mounted to the second side with a mechanical connection included on the pivot member directed towards the support surface. The support surface includes an aperture aligned with the pivot member such that the pivot member may be manipulated from the first side to cause the pivot member/draw member to secure/unsecure a motor housing received in the receiving device.

In an additional aspect, a method for securing/unsecuring a router base includes coupling an adjustment device through a support surface to a mechanical connection included on a pivot member. The coupled adjustment device may be utilized to rotate the pivot member to secure/unsecure a received motor housing.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Referring generally now to FIGS. 1 through 7, exemplary embodiments of the present invention are shown. The mechanism and method of the present invention may overcome the difficulties associated with manipulating a base securing mechanism such as when implemented with a router table and the like. Those of skill in the art will appreciate that the mechanism and method of the present invention may be implemented in either a standard or plunge type router without departing from the scope and spirit of the present invention.

Figure 1:
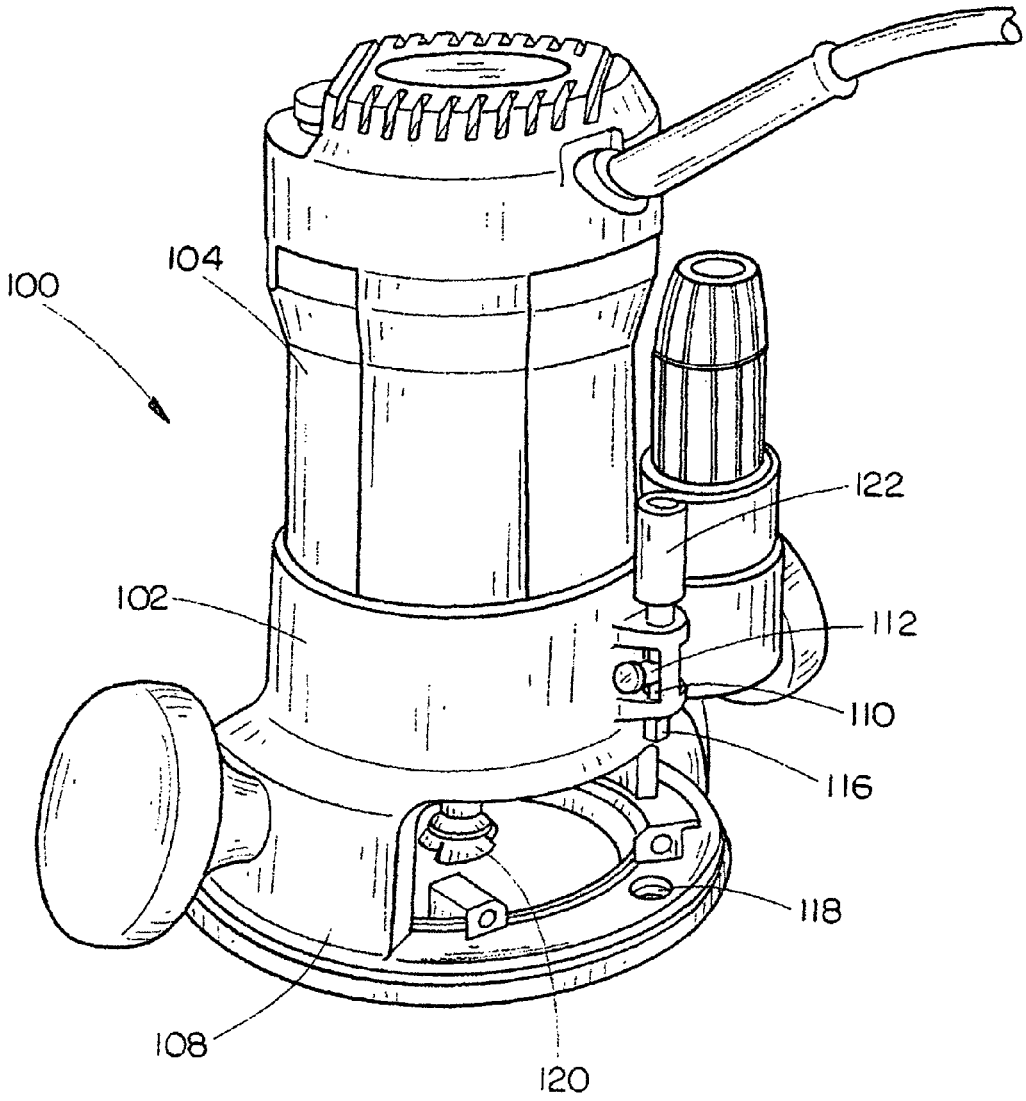
FIG. 1 is a perspective view of a router, including a base with a securing mechanism.
Figure 2:
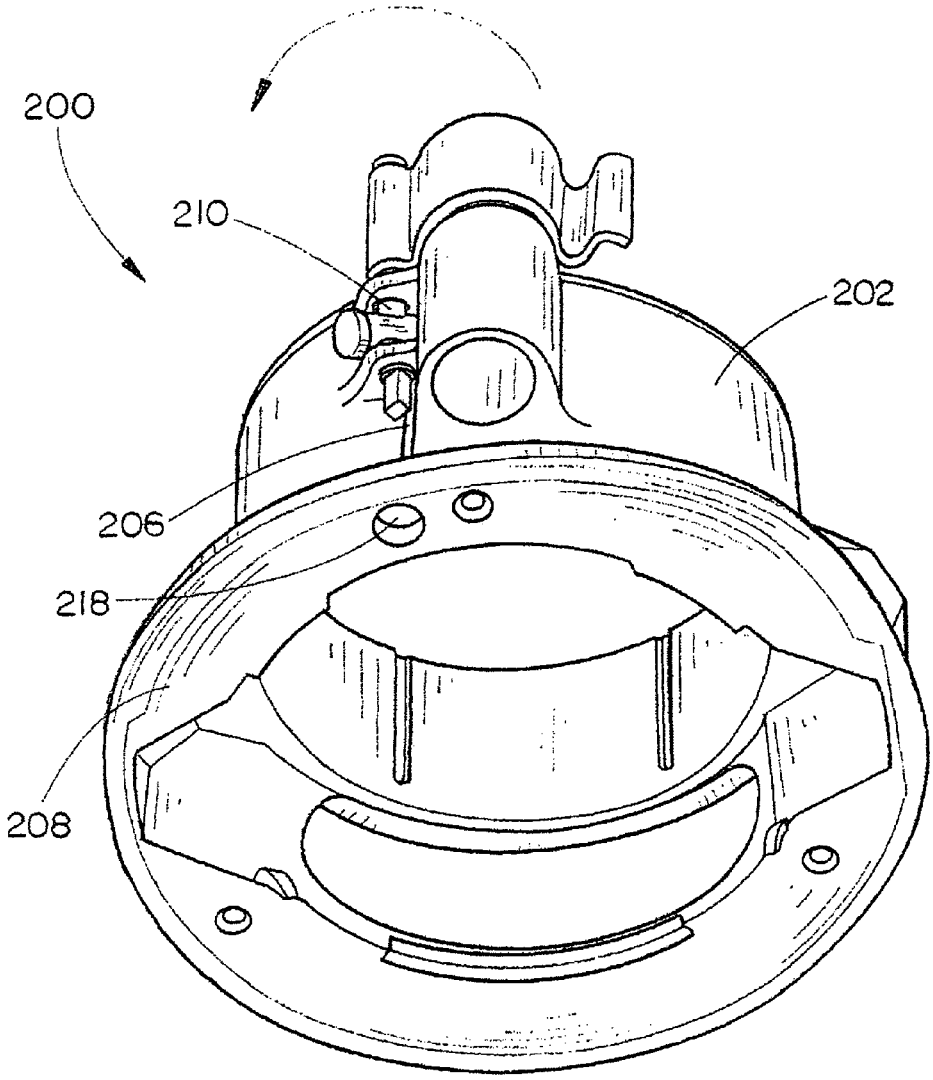
FIG. 2 is a perspective view of a base including a pivot member with a mechanical connection.

Referring to FIGS. 1 and 2, a base 100, 200 is discussed. The base 100, 200 includes a receiving portion 102, 202 for accepting a motor housing 104, 204. For instance, the receiving portion includes an interior recess for accepting a generally cylindrical portion of the motor housing 104. The receiving portion 102, 202 includes a seam 206 extending generally parallel to the received motor housing 104. The receiving portion 102, 202 is sized so as to allow the motor housing 104 to travel in the base 100, 200 to achieve desired cut-depth for an associated bit 120.

A pivot member 110, 210 is pivotally mounted to the receiving portion adjacent to the seam 206. For example, the pivot member is mounted in an anchor block which is formed integral to the receiving portion. Moreover, the location of the pivot member 110, 210 and seam 206 may be varied to allow for convenient grasping of the base/motor housing and the like.

The receiving portion 102, 202 connects to a sub-base 108, 208 for supporting a router on a workpiece or facilitating mounting to a router table. For example, the sub-base permits changing base-plates to achieve various functionality and the like. In the present embodiment, the receiving portion and the sub-base portion are formed as a unitary structure, in further embodiments, the receiving portion and the sub-base are formed separately and connected via fasteners and the like. In embodiments where the sub-base extends beyond the pivot member, the sub-base includes an aperture 118, 218 aligned with the pivot member 110, 210 to permit an adjustment device to couple to a mechanical connection included on a pivot member.

Figure 3A:
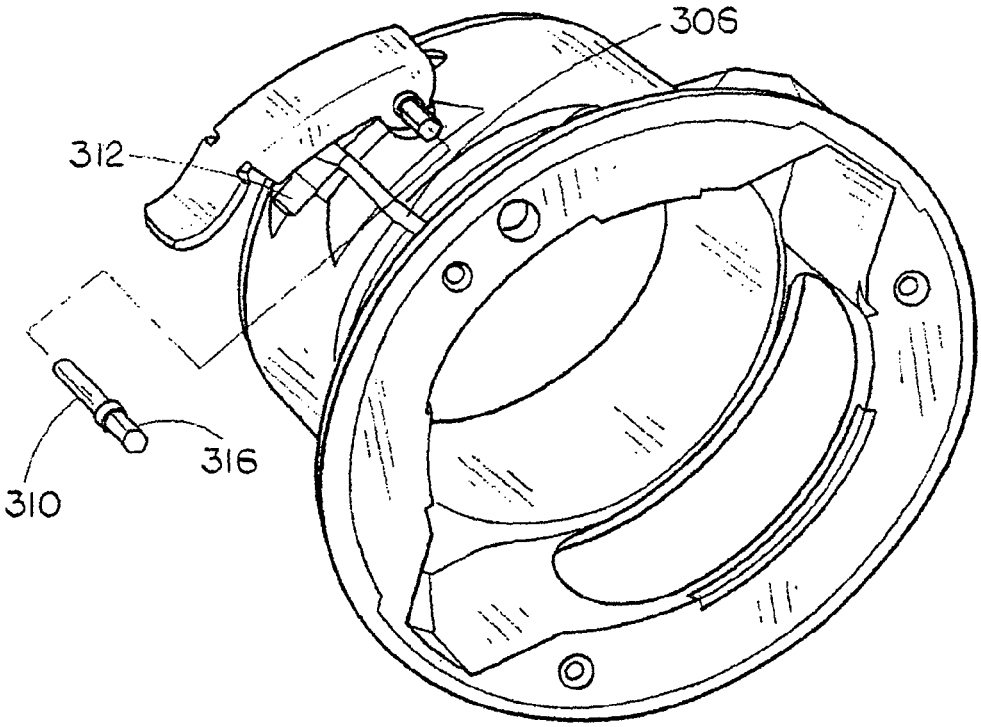
FIG. 3A is a partially exploded view of a base including a pivot member with a mechanical connection.
Figure 3B:
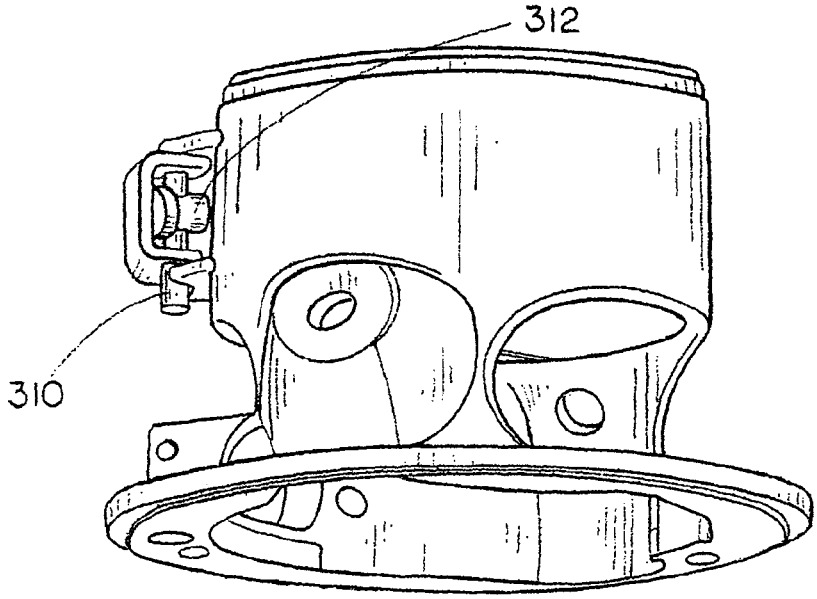
FIG. 3B is a perspective side view of a base including a base end securing mechanism.
Figure 3C:
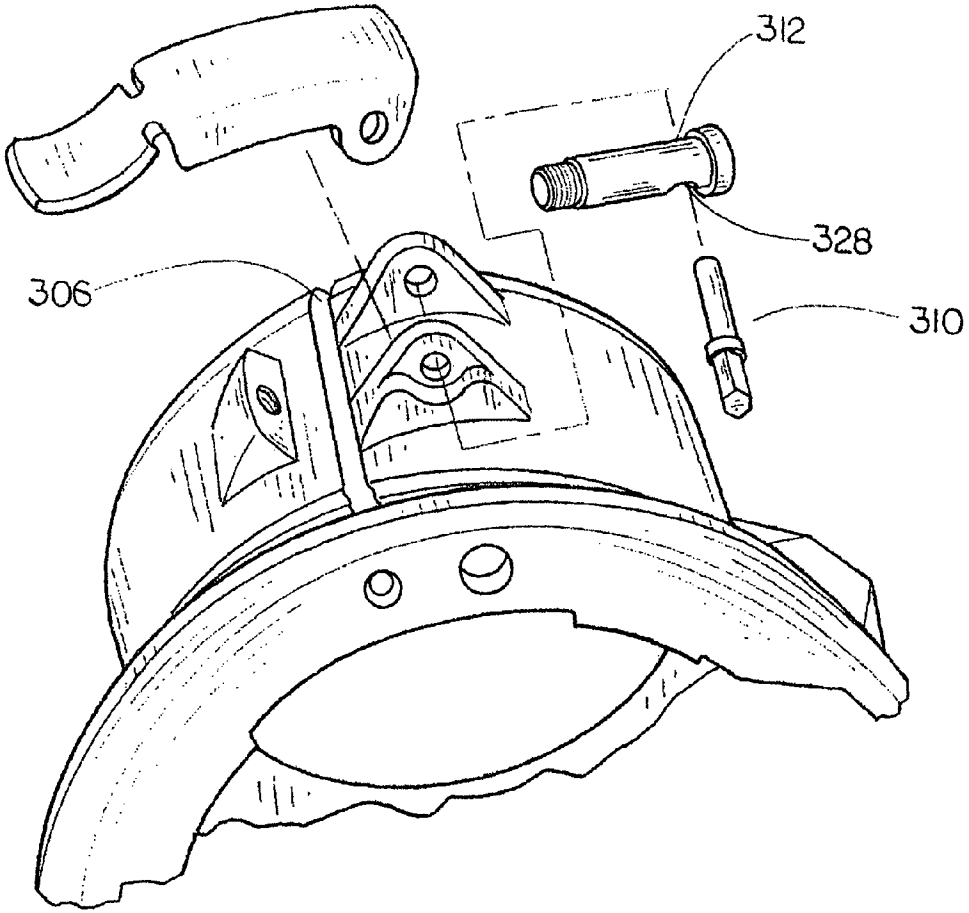
FIG. 3C is an exploded view of the base of FIG. 3B.

As may be best seen in FIG. 3A, a pivot member 310 includes a mechanical connection on an end directed away from a received motor housing and generally towards the base/sub-base end. For example, the mechanical connection is a hex head 316. In further embodiments, the mechanical connection is a socket for receiving an Allen wrench, a square socket for receiving a square bit, a square head, a slot head, a Phillips head, a Torx head, and the like. The mechanical connection is suited for connecting with a corresponding mechanical connection included on a wrench or adjustment device for adjusting the pivot member 310. See generally FIG. 6, wherein an adjustment device is utilized for adjusting a base securing mechanism. For instance, an adjustment device is coupled to the mechanical connection through a sub-base, and associated base plate to permit adjustment.

Additionally, the pivot member may include a knob 122 mounted to a end of the pivot member opposite the mechanical connection. The knob 122 may be utilized to rotate the pivot member when the base is orientated on a work surface and the like.

Referring to FIGS. 1 through 3C, a draw member 112, 212, 312 is connected to the pivot member 110, 210, 310 and to the receiving portion across the seam 206, 306 from the pivot member. For instance, the draw member includes a threaded segment which is received in a threaded aperture in the receiving portion 104 opposite the pivot member. The draw member 112, 212, 312 may be utilized to draw together the receiving portion. For example, tensioning against the draw member results in the seam closing-up and the motor housing 104 being secured at a specific depth. As may be seen in FIG. 3C, the draw member 310 includes an aperture 328 extending perpendicular to the member main axis. A draw member including an aperture allows a pivot member to extend therethrough while permitting rotation of the pivot member. Moreover, the draw member may include a mechanical connection, such as a flat head slot to aid in threading the member into a threaded aperture.

Figure 4B:
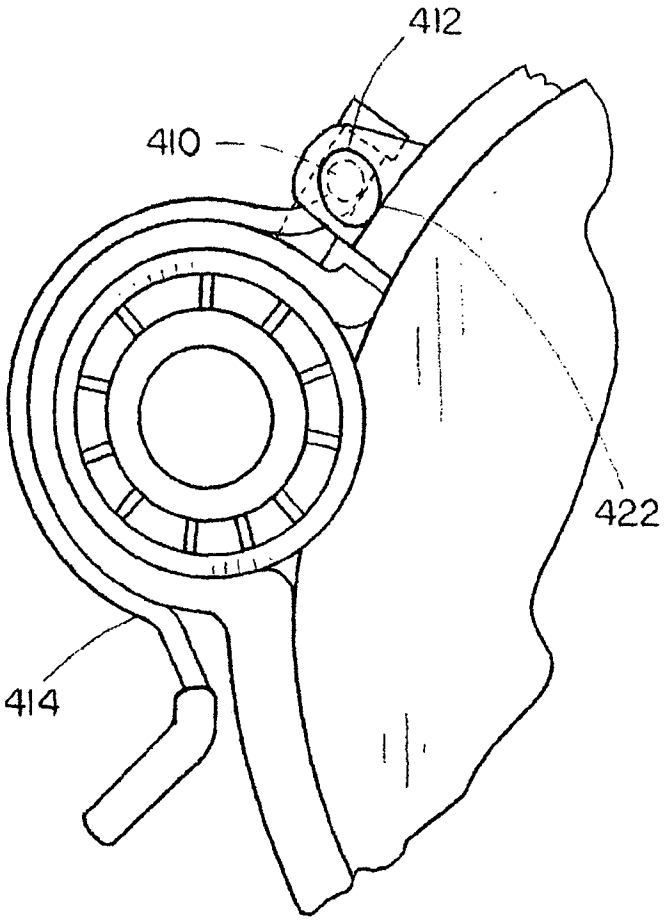
FIG. 4B is a cut away of a securing mechanism including a pivot member with a curved surface.
Figure 4A:
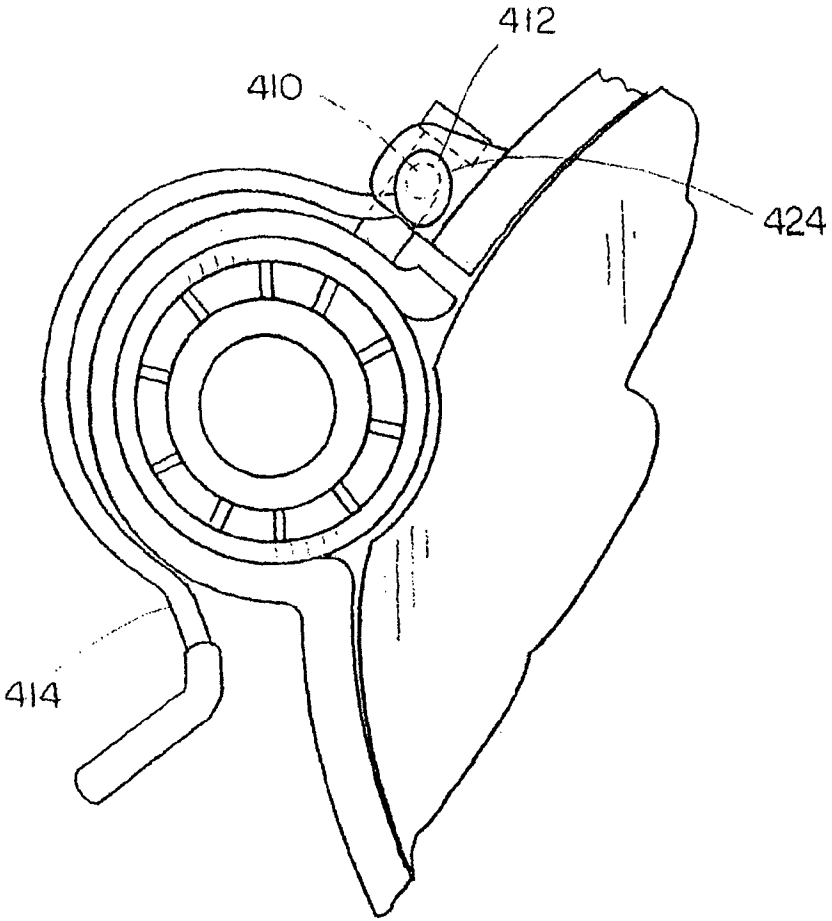
FIG. 4A is a cut away view of a securing mechanism including a lever with a curved surface.

Referring now to FIGS. 4A and 4B, tensioning/releasing a draw member 412 may be accomplished by implementing a pivot member 410 and/or a lever 414 with a cam surface or a curved surface portion, so that rotation of the pivot member/lever results in the tensioning or releasing of an associated draw member 412. As may be best seen in FIG. 4B, a pivot member 410 may include a curved portion 422 with a varying radius. In other words, a portion of the pivot member 410 and/or a lever 414 (FIG. 4A), may not be circular. Variance from circularity may permit tensioning/releasing of the draw member via the pivot member and/or lever coming in contact with a surface of the receiving portion and the like. See FIG. 4A for a lever 414 having a curved portion 424. Moreover, the lever 414 may be contoured to minimize protrusion and or to permit securing to the receiving portion 402.

When a lever with a curved portion 424 or segment is employed, the lever may be connected directly, via interlocking sections, and the like to the pivot member. Connecting the lever and pivot member in this fashion allows base end manipulation, such as securing/un-securing of the base. In another example, a sleeve may be utilized to rotate a lever, and the like. In additional embodiments, a curved slot allows the pivot member to vary position to draw the seam closed. For example, the pivot member may clamp around a protrusion in the receiving portion, such as a protrusion formed in the receiving portion to house a height adjustment device. Those of skill in the art will appreciate that various configurations may be implemented without departing from the scope and spirit of the present invention.

Figure 5C:
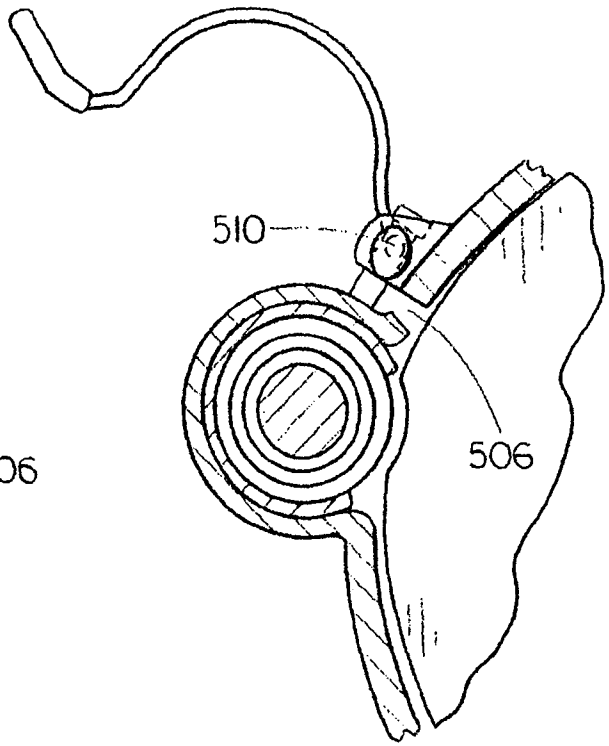
FIG. 5C is a cut away view of a base including a pivot member disposed in a releasing orientation.
Figure 5B:
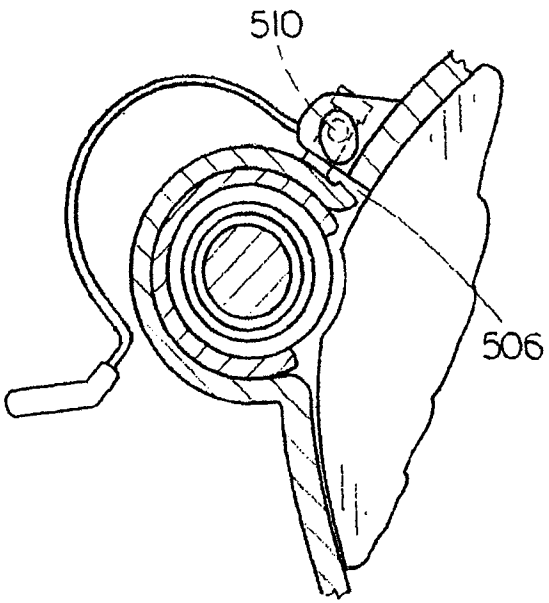
FIG. 5B is a cut away view of a base including a pivot member disposed in a positioning orientation.
Figure 5A:
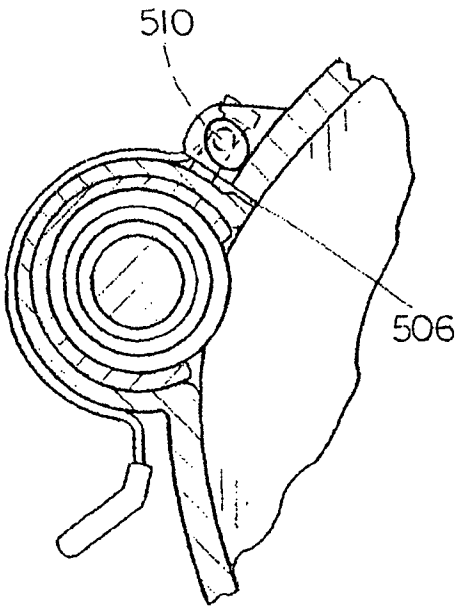
FIG. 5A is a cut away view of a base including a pivot member disposed in a securing orientation.

As may be seen in FIGS. 5A through 5C, a pivot member 510, and thus the securing mechanism, may obtain a plurality of orientations. Orientations correspond to functional tasks such as securing a motor housing in a desired position, allowing height positioning, and releasing the motor housing from the base. For example, when an adjustment device is connected to the pivot member a user may manipulate the pivot member 510 to adjust orientations and the like.

Referring now to FIG. 5A, in a securing orientation the pivot member 510 may position a seam in a drawn-up position, resulting in a receiving portion to act generally as a clamp around the motor housing. In a securing orientation, a received motor housing may be locked at a specific depth.

Referring to FIG. 5B, in a positioning orientation the pivot member 510 may position the seam 506 in an intermediate partially drawn-up position. Thus, a received motor housing may be adjusted to a desired height. For example, if a worm drive adjustment device is employed an intermediate position may allow for depth adjustment without releasing the motor housing. Mechanical stops, spring levers, restraints, and the like may be used to indicate the orientation and/or cause hesitation during rotation of the pivot member 510.

Referring to FIG. 5C, in a releasing orientation the pivot member 510 may position the receiving portion such that a motor housing may be released. For example, in a released orientation the motor housing may be free to move in the base. When released, a motor housing may be free of an adjustment device. For instance, a height adjustment device may disengage from the motor housing when in a released orientation.

Figure 6:
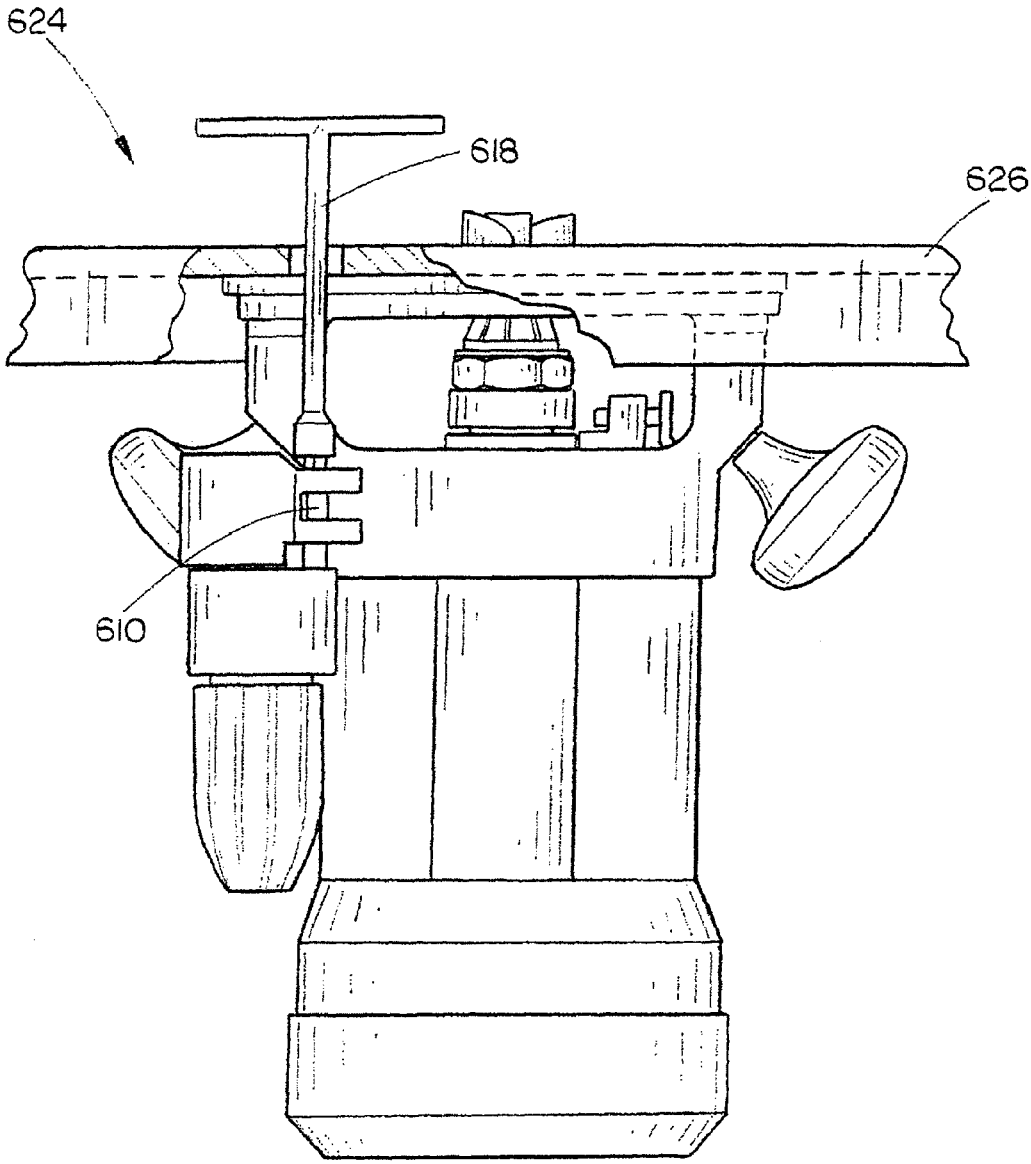
FIG. 6 is a detailed side view of a router table utilized in conjunction with a router base securing mechanism.

Referring now to FIG. 6, in a further example, a router including a base securing mechanism is implemented with a router table 624. Previously, one difficulty with a router/router table combination was the inability to secure/un-secure a motor housing to allow for height adjustment, or removal of the motor housing. The inclusion of a mechanical connection on a pivot member 610 allows a user to manipulate the base without reaching under a support surface 626. For example, a user may wish to change bits. Previously, in order to change depth a user would have reach under the table and release the securing device, position the router, and then re-secure the device. A securing mechanism of the present invention allows an adjustment device 618 to extend through a support surface 626 to a mechanical connection included on a pivot member 610. An adjustment device 618 includes a corresponding mechanical connection to the mechanical connection included on a pivot member.

Figure 7:
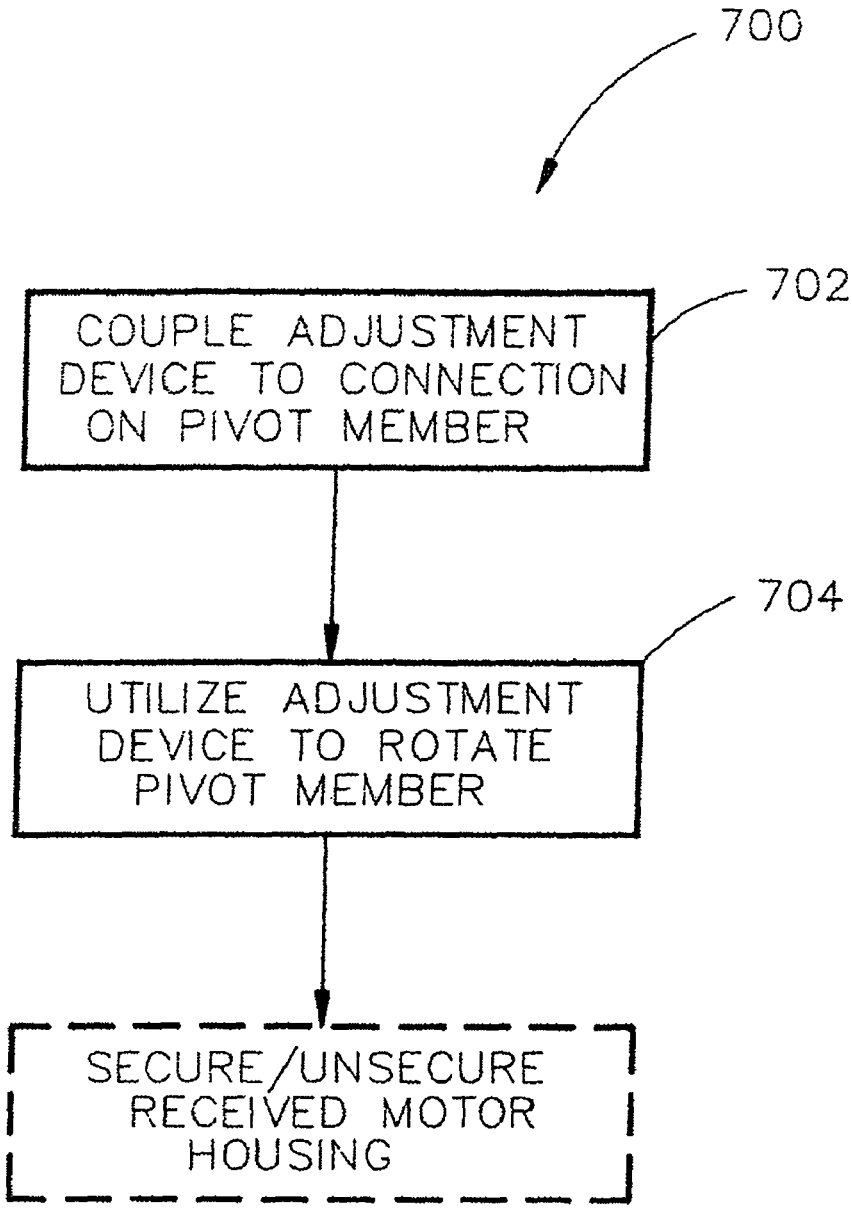
FIG. 7 is a flow diagram illustrating a method for permitting base end securing adjustment.

Referring to FIG. 7 a method 700 for securing/unsecuring a router base is discussed. Initially, an adjustment device is coupled 702 to a mechanical connection through a support surface. The adjustment device includes a mechanical connection corresponding to the mechanical connection included on the pivot member. The adjustment device is utilized 704 to rotate the pivot member. Rotating the pivot member results in the securing/unsecuring of a motor housing. For example, the pivot member may achieve a plurality of orientations such as a securing orientation, a positioning orientation and a releasing orientation.

Further, it is understood that the specific order or hierarchy of steps in the methods disclosed are examples of exemplary approaches. Based upon design preferences, it is understood that the specific order or hierarchy of steps in the method can be rearranged while remaining within the scope of the present invention. The accompanying method claims present elements of the various steps in a sample order, and are not meant to be limited to the specific order or hierarchy presented It is believed that the apparatus and method of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A method for one of securing and unsecuring a router motor housing into a router base through a support surface, the router base having a receiving portion for accepting the router motor housing, the receiving portion having a seam, and a pivot member for securing/unsecuring the router motor housing to the router base, the method comprising;

placing the router base on the support surface;

inserting the router motor housing into the router base;

inserting a draw member having an aperture into the receiving position across the seam;

inserting the pivot member through the aperture in the draw member;

coupling an adjustment device through the support surface to a mechanical connection located on an end of the pivot member and having a free end directed away from the inserted router motor housing; and turning the adjustment device to rotate the pivot member, wherein rotating the pivot member tensions and releases the draw member across the seam to close and open the seam, respectively, resulting in at least one of securing and unsecuring the router motor housing into the router base.

2. The method of claim 1, wherein rotating the pivot member achieves a plurality of orientations.

3. The method of claim 1, wherein the mechanical connection is one of a hex head, a socket, a slot head, a Phillips head, and a Torx head.

4. A method for adjusting a motor housing in a router base through a support surface, the router base having a receiving portion for accepting the motor housing, the receiving portion having a seam, and a pivot member for adjusting the motor housing in the router base, the method comprising:

placing the router base on the support surface;

inserting the motor housing into the router base;

inserting a draw member having an aperture into the receiving position across the seam;

inserting the pivot member through the aperture in the draw member;

coupling an adjustment device through the support surface to a mechanical connection located on an end of the pivot member and having a free end directed away from the inserted motor housing; and turning the adjustment device to rotate the pivot member, wherein rotating the pivot member releases the draw member across the seam to open the seam, allowing the motor housing to move between at least one of a securing orientation, a positioning orientation, and a releasing orientation in the router base.

5. The method of claim 4, wherein the mechanical connection is one of a hex head, a socket, a slot head, a Phillips head, and a Torx head.

* * * * *